US009530393B1

(12) United States Patent
Corcorran et al.

(10) Patent No.: US 9,530,393 B1
(45) Date of Patent: Dec. 27, 2016

(54) ERGONOMIC INSTRUMENT STRAP

(71) Applicants: Holly Corcorran, Gold Bar, WA (US); Patrick Corcorran, Gold Bar, WA (US)

(72) Inventors: Holly Corcorran, Gold Bar, WA (US); Patrick Corcorran, Gold Bar, WA (US)

( * ) Notice: Subject to any disclaimer, the term of this patent is extended or adjusted under 35 U.S.C. 154(b) by 0 days.

(21) Appl. No.: 14/811,774

(22) Filed: Jul. 28, 2015

(51) Int. Cl.
*G10G 5/00* (2006.01)
*G10D 3/16* (2006.01)

(52) U.S. Cl.
CPC ..... *G10G 5/005* (2013.01); *G10D 3/163* (2013.01)

(58) Field of Classification Search
CPC ..... G10G 5/005
See application file for complete search history.

(56) References Cited

U.S. PATENT DOCUMENTS

D33,567 S * 11/1900 Vitzthum ..... D2/627
4,148,423 A * 4/1979 Schlacher ..... G10G 5/005 224/258
4,401,246 A * 8/1983 Dickinson ..... F41C 33/002 224/150
4,785,708 A * 11/1988 Vaughan ..... G10D 3/163 84/322
4,976,388 A * 12/1990 Coontz ..... A45C 13/30 224/150
D325,470 S * 4/1992 Harms ..... 224/258
5,143,266 A * 9/1992 Heckerman ..... A44B 11/006 224/150
D335,136 S * 4/1993 McMichael ..... D17/20
5,299,485 A * 4/1994 Denton ..... G10D 3/163 84/319
5,503,315 A * 4/1996 Ruzika ..... G10G 5/00 224/257
5,905,217 A * 5/1999 Byers ..... G10D 3/163 84/320
6,140,564 A * 10/2000 Pia ..... G10D 3/163 84/320
6,169,238 B1 * 1/2001 Bolo, III ..... G10D 3/163 24/545
D508,516 S * 8/2005 Boone ..... D17/20
(Continued)

OTHER PUBLICATIONS

Mono Betty Guitar Strap, on sale at Amazon Oct. 29, 2010, showing a pick pocket opening to the side, viewed at http://www.amazon.com/MONO-GS1-BTY-GRY-L-Betty-Guitar-Strap/dp/B0049T1O1C on May 4, 2016.*

*Primary Examiner* — Robert W Horn
(74) *Attorney, Agent, or Firm* — Michelle E. Carey; Telekta Law, P.S.

(57) ABSTRACT

An ergonomic instrument strap designed to eliminate pressure points on a user's shoulder, neck, and back, and wear points on the strap. Unique curves in a portion of the strap draw the downward force out toward user's arm while shifting the strap off a user's shoulder blade, reducing fatigue on neck, back, and shoulder muscles. A wider portion over the shoulder helps to distribute force over wider area, reducing stress load on any one point. Additional layers of cloth and padding help to prevent strong downward forces, increasing comfort for the user. May be left orientation, right orientation, or reversible. Strap may include end pieces. Strap end pieces contain pockets with opening facing the user's body to allow the user to quickly recover if a pick is lost. Side opening prevents pick falling into pocket and becoming irretrievable. Strap may contain zero, one, or two end pieces.

17 Claims, 12 Drawing Sheets

(56) References Cited

U.S. PATENT DOCUMENTS

| | | | | |
|---|---|---|---|---|
| 7,048,161 | B2 * | 5/2006 | George | F41C 23/02 224/150 |
| 7,205,467 | B2 * | 4/2007 | Tafolla | G10G 5/005 84/327 |
| D574,415 | S * | 8/2008 | Koskela | D17/20 |
| 7,417,184 | B2 * | 8/2008 | Weathersby | G10D 3/163 84/322 |
| 7,507,889 | B2 * | 3/2009 | Montgomery | G10G 5/005 224/264 |
| D674,431 | S * | 1/2013 | Kim | D16/243 |
| 8,618,393 | B1 * | 12/2013 | Peters | G10D 1/08 84/327 |
| 8,710,341 | B2 * | 4/2014 | Bowen | G10G 5/005 84/327 |
| D711,963 | S * | 8/2014 | Gilmore | D17/20 |
| 8,800,829 | B2 * | 8/2014 | Bergenudd | A45F 3/12 224/201 |
| D750,349 | S * | 3/2016 | Henry | D2/853 |
| 2004/0060951 | A1 * | 4/2004 | Kelly | A45F 3/12 224/264 |
| 2004/0094585 | A1 * | 5/2004 | Walker | G10G 5/005 224/257 |
| 2009/0072563 | A1 * | 3/2009 | Phillips | A45F 3/12 294/149 |
| 2013/0152766 | A1 * | 6/2013 | Perrault | G10G 7/00 84/453 |

* cited by examiner

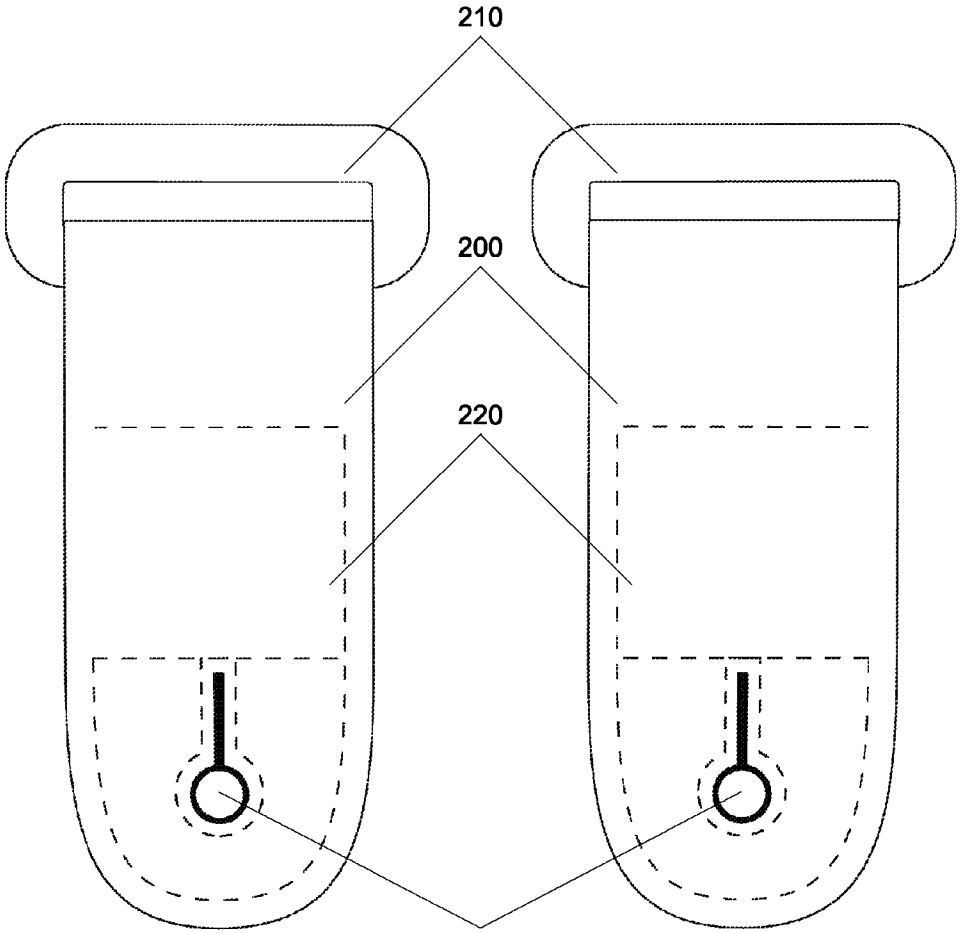
Fig. 14
Fig. 15
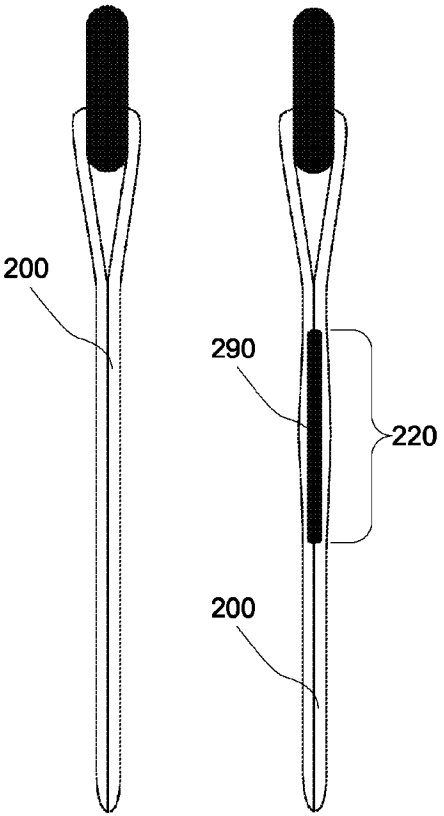
Fig. 12
Fig. 13

ERGONOMIC INSTRUMENT STRAP

FIELD OF THE INVENTION

This invention relates generally to stringed instrument straps and specifically to straps designed for ergonomic use during performances.

BACKGROUND

Plucked string instrument players are met with two particular ergonomic problems during play: first, the proper holding of the instrument: second, the use and holding of a pick. Regarding the first problem, straps have been in use since the early 1900s, and those first used then largely resemble what is in use today, namely a strap that attaches to a point on the neck and a point on the body, and that is draped over one of the user's shoulders, neck, and back. This conventional strap, though functional, creates a pressure point on the shoulder of the user, causing pain, and a wear point on the strap, causing degradation of the strap.

Regarding the second problem, plucked instrument players often lose their picks during play. Though pick holders are available on the market, they often attach to the structure of the instrument or the microphone stand, causing the player to disrupt play to retrieve another pick. Depending on the nature of the instrument, adding a pick holder could change the sound of the instrument, which is an undesirable result. Players also store additional picks in their pockets, on stage, or with other band members or road assistance, again causing a disruption in the performance to retrieve a replacement pick. Past attempts at such a solution are insecure, leading to the player reaching for a pick that is no longer available, or further exacerbate the disruption by causing the player additional effort to retrieve the pick.

The present invention aims to address both these problems, first by eliminating the pressure point on the shoulder, neck, and back of the player, and second by providing a pocket for additional picks that is easy to access and ergonomically sound. This invention allows a player to play for an extended time by both increasing comfort and decreasing or eliminating disruptions to acquire replacement picks.

SUMMARY OF THE INVENTION

This invention relates generally to stringed instrument straps and specifically to straps designed for ergonomic use during practice or performance.

The ergonomic instrument strap disclosed herein provides a comfortable strap with easy, secure access to additional picks. The combination allows a player to more comfortably hold the instrument for an extended period of time. Moreover, the combination allows a player to reach for an additional pick with very little effort, leading to a minimal disruption of play.

In some embodiments, the instrument strap is comprised of a length of flexible material and at least one end piece coupled with a first end of the length of flexible material, wherein the at least one end piece is comprised of a first end, a middle, and a second end, wherein the first end is coupled with the second end, and the material is folded in the middle through a single loop. In some embodiments, the first end coupled with the second end creates a pocket. In some embodiments, the at least one end piece is further comprised of a button hole disposed through the first end coupled with the second end. In some embodiments, the pocket opens on a side of the end piece. In one further embodiment, the pocket opens on a side of the end piece facing a user's body. In some embodiments, the instrument strap may be further comprised of a second end piece, the second end piece coupled with a second end of the length of material. In some embodiments, the second end piece is configured like the first. In other embodiments, the second end piece may be configured differently than the first. In some embodiments, the end pieces may be interchangeable. In other embodiments, the end pieces may not be interchangeable. In some embodiments, the end piece or end pieces may be removable. In other embodiments, the end piece or pieces may be permanently coupled with the length of flexible material.

In some embodiments, the instrument strap may be further comprised of a narrow first portion beginning at the neck end; a wide second portion beginning at the end of the first portion; and a narrow third portion beginning at the end of the second portion.

In some embodiments, the instrument strap may be comprised of a length of flexible material having a neck end and a body end, the length of flexible material further comprising: a narrow first portion beginning at the neck end; a wide second portion beginning at the end of the first portion; and a narrow third portion beginning at the end of the second portion; and at least a first end piece coupled with the length of flexible material at one of the neck end or the body end. In some embodiments, the instrument strap may include a padded portion coupled with and substantially the same size as the wide second portion of the length of flexible material. In some embodiments, the instrument strap may include a second end piece coupled with the length of flexible material at one of the neck end or the body end. In some embodiments, the wide second portion of the length of flexible material may be substantially s-shaped. In some embodiments, the wide second portion of the length of flexible material may curve away from the user's body.

In some embodiments, the instrument strap end piece coupled with the length of flexible material may be further comprised of a double layer of material stitched together to form a pocket. In a further embodiments, the pocket may open on a side of the end piece. In some embodiments, the pocket may open on a side of the end piece facing the user's body. In some embodiments, the instrument strap end piece coupled with the length of flexible material may be further comprised of a first end, a middle, and a second end, wherein the first end is coupled with the second end, and the material is folded in the middle through a single loop. In some embodiments, the instrument strap end piece may contain a pin hole. In some embodiments, the pin hole may be located where the first end is coupled with the second end.

In some embodiments, the instrument strap may include at least one length adjuster. In some embodiments, the length adjuster may be located near the neck end of the length of flexible material. In other embodiments, the length adjuster may be located near the body end of the length of flexible material. In some embodiments, the instrument strap may include a second length adjuster. In a further embodiment, the second length adjuster may be located near the body end of the length of flexible material. In a different further embodiment, the second length adjuster may be located near the neck end of the length of flexible material. In some embodiments, the two length adjusters may be identical. In other embodiments, the two length adjusters may be different. In some embodiments, the length adjusters may be interchangeable. In other embodiments, the length adjusters may not be interchangeable.

In some embodiments, the end piece may comprise a first end and a second end and a pocket, the pocket disposed between the first end and the second end. In some embodiments, the end piece may include a button hole, the button hole disposed through the second end of the end piece. In some embodiments, the end piece pocket may open on a side of the end piece. In one further embodiment, the end piece pocket may open on a side of the end piece facing a user's body. In a different further embodiment, the pocket may open on a side of the end piece facing away from a user's body. In some embodiments, the end piece may include a double layer of material stitched together to form a pocket. In some embodiments, the height of the pocket may be substantially the same size as the width of an instrument pick at its widest point. In some embodiments, the depth of the pocket may be substantially the same as the length of an instrument pick. In some embodiments, the height of the pocket may be slightly smaller than the width of an instrument pick at its widest point.

In some embodiments, the end piece may comprise a first end, a middle, and a second end, wherein the first end is coupled with the second end and wherein the first end coupled with the second end creates a pocket. In some embodiments, the pocket may open on a side of the end piece. In some embodiments, the pocket may open on a side of the end piece facing the user's body. In some embodiments, the first end coupled with the second end may contain a pin hole. In some embodiments, the end piece may include a single loop, wherein the middle of the end piece is disposed through the single loop.

In some embodiments, the end piece may be comprised of a first end and a second end and a pocket, the pocket further comprising: a top seam, the top seam oriented near the first end of the end piece; a bottom seam, the bottom seam oriented near the second end of the end piece; and a side seam, the side seam connecting the top seam and the bottom seam such that the opposing side is left open. In some embodiments, the open side may be facing a user's body. In some embodiments, the distance between the top seam and the bottom seam may be substantially the same size as a standard instrument pick at its widest point. In other embodiments, the distance between the top seam and the bottom seam may be narrower or wider than a standard instrument pick at its widest point.

In addition to the foregoing, various other methods, systems and/or program product embodiments are set forth and described in the teachings such as the text (e.g., claims, drawings and/or the detailed description) and/or drawings of the present disclosure.

The foregoing is a summary and thus contains, by necessity, simplifications, generalizations and omissions of detail; consequently, those skilled in the art will appreciate that the summary is illustrative only and is NOT intended to be in any way limiting. Other aspects, embodiments, features and advantages of the device and/or processes and/or other subject matter described herein will become apparent in the teachings set forth herein.

BRIEF DESCRIPTION OF THE DRAWINGS

Certain embodiments of the present invention are described in detail below with reference to the following drawings:

FIG. 12 is an outside view thereof.

FIG. 13 is an inside view of one embodiment of the ergonomic instrument strap end piece with a pick in place.

FIG. 14 is a front view of one embodiment of the ergonomic instrument strap end piece.

FIG. 15 is a rear view thereof.

DETAILED DESCRIPTION

This invention relates generally to stringed instrument straps and specifically to straps designed for ergonomic use during performances. Specific details of certain embodiments of the invention are set forth in the following description and in FIGS. 1-20 to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

The present invention is an instrument strap designed to allow users more continuous play by increasing comfort. In some embodiments, the strap may also provide secure storage for additional picks, which are often lost during play.

Figure 1:
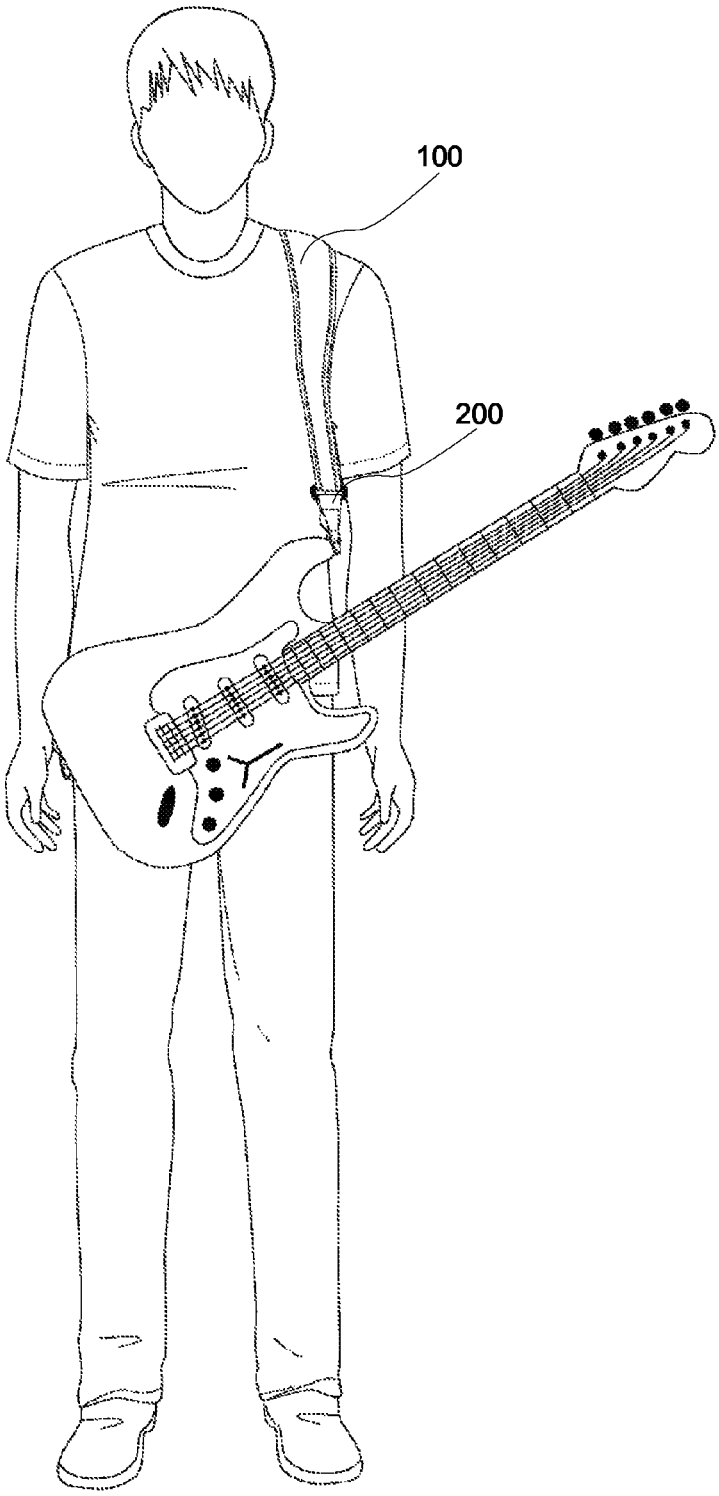
FIG. 1 is an environmental front view of the ergonomic instrument strap in use.
Figure 2:
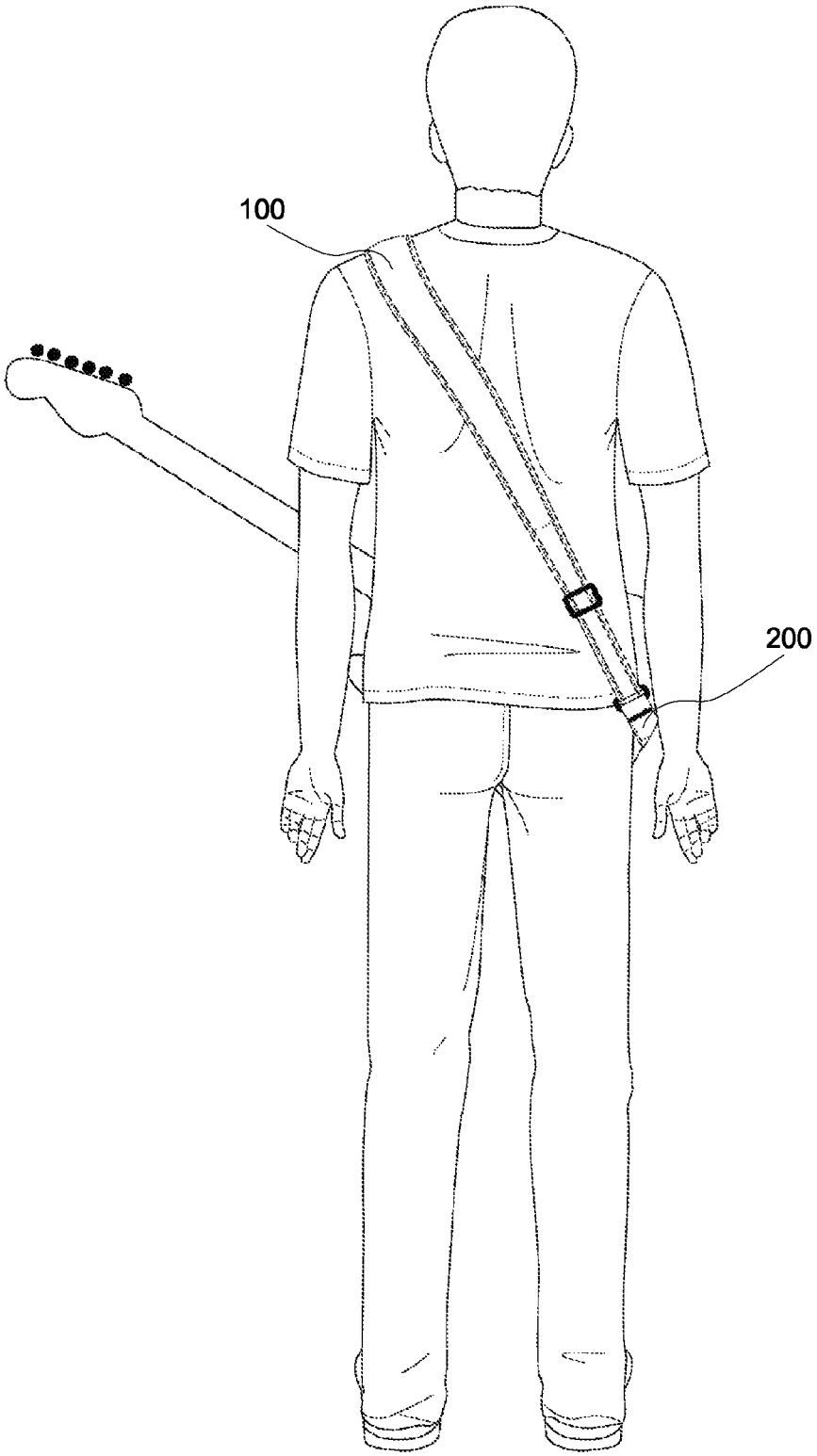
FIG. 2 is a rear view thereof.

FIG. 1 is an environmental front view of one embodiment of the ergonomic instrument strap 100, shown on a user's body. In some embodiments, strap 100 may be coupled with end piece 200 near the neck end of the strap. FIG. 2 is an environmental rear view of one embodiment of the ergonomic instrument strap 100, shown on a user's body. In some embodiments, strap 100 may be coupled with end piece 200 near the body end of the strap.

Figure 3:
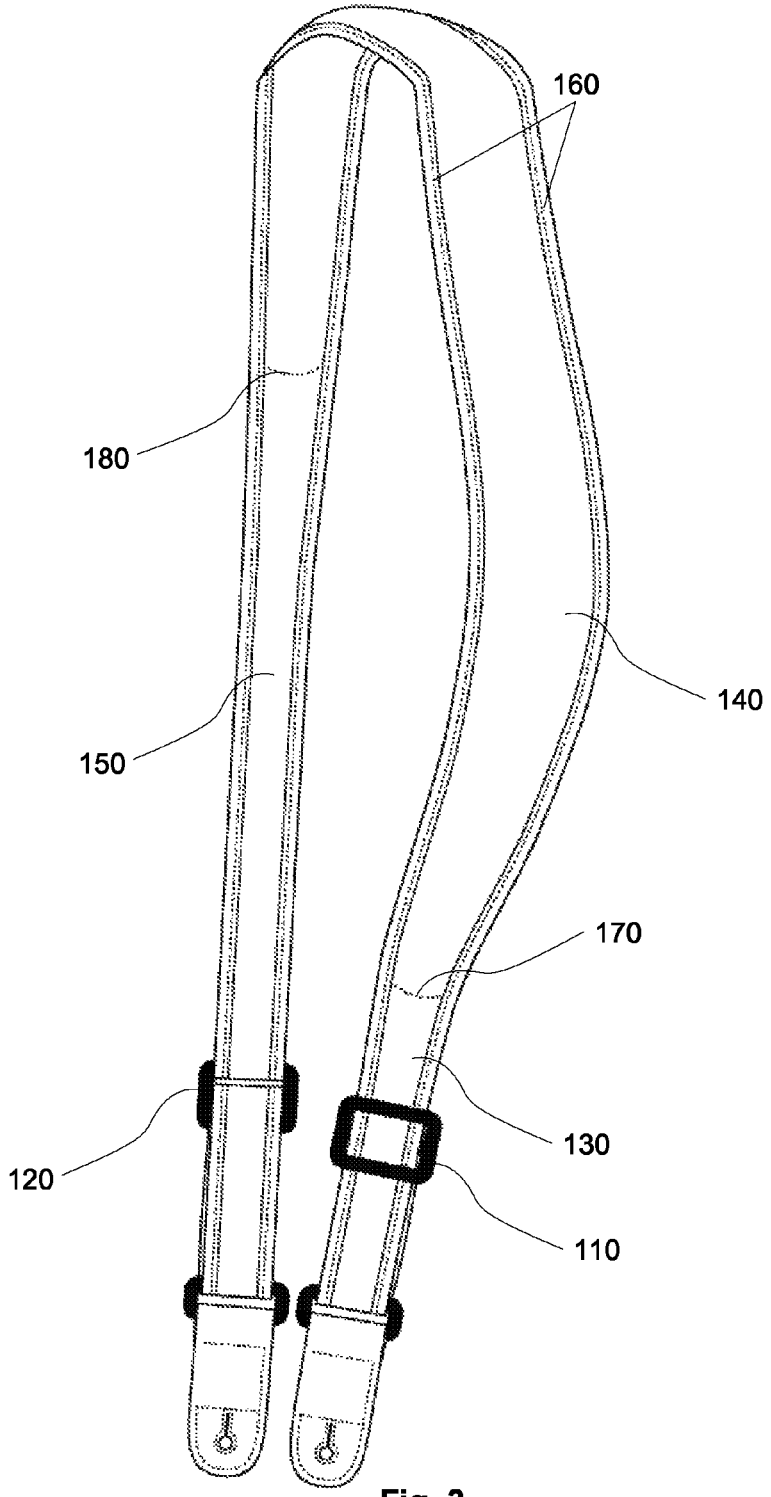
FIG. 3 is an isometric view of one embodiment of the ergonomic instrument strap.

FIG. 3 is an isometric view of one embodiment of strap 100. Strap 100 will generally have a neck end, which attaches to a plucked instrument near or on the neck of the instrument, and a body end, which attaches to the body of the instrument. Plucked instruments generally have pins or buttons for such attachment, so this will not be discussed in detail herein. Strap 100 will generally be comprised of a flexible or semi-flexible material, such as cloth, leather, nylon webbing, etc. The type of material chosen may depend in part on what the particular user intends to do with strap 100, so any flexible or semi-flexible material generally suited for clothing or straps should be considered within the scope of this application. In some embodiments, strap 100 may have a first length adjuster 110. In some embodiments, length adjuster 110 may be a sliplock style buckle, which causes strap 100 to be doubled up on itself to shorten the length of the strap. In other embodiments, length adjuster 110 may be a retraction mechanism, a locking gear mechanism, an inertia reel, or any other means of adjusting the length of a strap. In some embodiments, strap 100 may include a second length adjuster 120. In some embodiments, length adjuster 110 may be the same mechanism as length adjuster 120. In other embodiments, length adjuster 110 may be a different mechanism than length adjuster 120. In some embodiments, length adjuster 110 may be near the neck end of strap 100, where "near" means closer than one-half the length of the strap. In other embodiments, length adjuster 110 may be near the body end of strap 100. In some embodiments, length adjuster 120 may be near the neck end of strap 100. In other embodiments, length adjuster 120 may be near the body end of strap 100.

In some embodiments, strap 100 is comprised of a first section 130. In some embodiments, section 130 is a relatively narrow section that can be pushed and pulled through length adjuster 110 to shorten or lengthen strap 100, respectively. In some embodiments, section 130 may be relatively short, comprising 10% or less of the length of strap 100. In other embodiments, section 130 may be relatively long, comprising up to 50% of the length of strap 100. Section 130 will generally begin at the neck end of strap 100. In some embodiments, section 130 will be joined with second section 140. Second section 140 is, in some embodiments, a relatively wide section of strap 100. Section 140 will be discussed in greater detail with respect to FIGS. 4-8.

In some embodiments, section 130 may be coupled with second section 140 with a seam 170. Seam 170 may be comprised of any type of stitching, such as overlock, zig zag, bar tack, double needle, and, in a preferred embodiment, single needle stitch. In alternative embodiments, seam 170 can be comprised of welding, riveting, buttons, or other means of finishing or coupling fabric. In some embodiments, section 140 may be relatively short, comprising 10% or less of the length of strap 100. In other embodiments, section 140 may be relatively long, comprising up to 50% of the length of strap 100. Generally, section 140 will be positioned to rest on and fall over a user's shoulder to provide additional comfort during use. Therefore, the length of section 140 may vary depending on the user's preferences.

In some embodiments, strap 100 is further comprised of a third section 150. In some embodiments, section 150 may be coupled with section 140 with a seam 180, wherein a "seam" is defined as a point at which two or more pieces of fabric are joined. Seam 180 may be comprised of any type of stitching, such as overlock, zig zag, bar tack, double needle, and, in a preferred embodiment, single needle stitch. In alternative embodiments, seam 180 can be comprised of welding, riveting, buttons, or other means of finishing or coupling fabric. In some embodiments, section 150 is a relatively narrow section that can be pushed and pulled through length adjuster 120 to shorten or lengthen strap 100, respectively. In some embodiments, section 150 may be relatively short, comprising 10% or less of the length of strap 100. In other embodiments, section 150 may be relatively long, comprising up to 50% of the length of strap 100. Section 150 will generally begin where section 140 ends and comprise the end of strap 100.

While a narrow-wide-narrow embodiment of the strap has been identified as a preferred embodiment, it is important to note that first section 130, second section 140, and third section 150 may, in some embodiments, be the same or substantially the same width. In other embodiments, one of sections 130, 140, and 150 may be comparatively wider than the others. In other embodiments, two of sections 130, 140, and 150 may be comparatively wider than the other. In still other embodiments, sections 130, 140, and 150 may all be different widths.

In some embodiments, strap 100 may be finished with inside and outside longitudinal seams 160, where, as above, a "seam" is defined as a point at which two or more pieces of fabric are joined. Seams 160 add structural integrity to strap 100, and can be comprised of any type of stitching, such as overlock, zig zag, bar tack, double needle, and, in a preferred embodiment, single needle stitch. In alternative embodiments, seams 160 can be comprised of welding, riveting, buttons, or other means of finishing or coupling fabric. In some embodiments, seams 160 may include one or more layers of material disposed over the edge of strap 100 to provide a finished edge.

Figure 4:
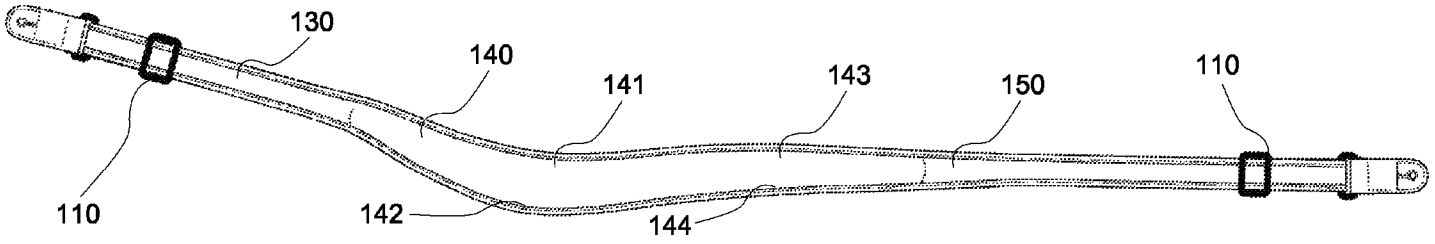
FIG. 4 is a front view thereof.
Figure 5:
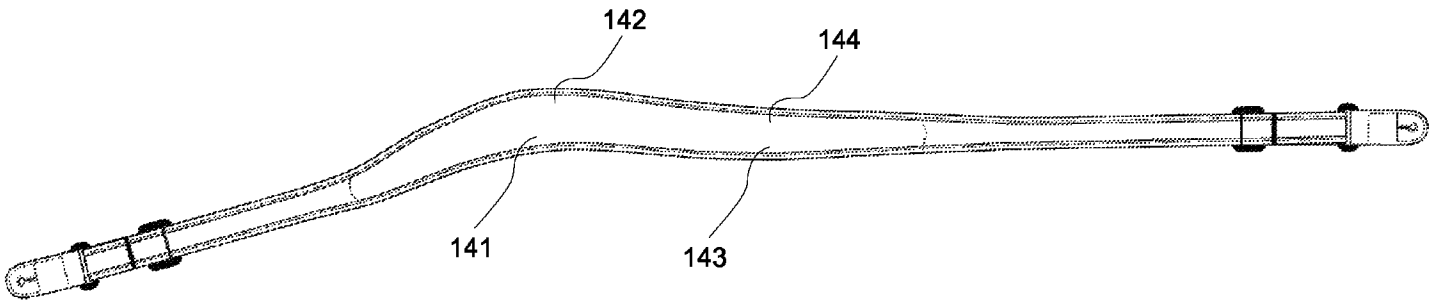
FIG. 5 is a rear view thereof.

FIG. 4 is a front view of one embodiment of the ergonomic instrument strap. Sections 130, 140, and 150, as discussed with FIG. 3, can be seen in the relative orientation that some embodiments of strap 100 may have. Additionally, FIG. 4 and FIG. 5 show the unique shape of strap 100. Strap 100 is designed to curve away from a user's body over the user's shoulder, reducing or eliminating stress on the user's neck muscles. This also helps to spread the downward force of strap 100 over a larger area of the user's shoulder, eliminating pressure points on the user's shoulder and wear points on the strap. In particular, second section 140 has a concave curve 141 on the inside of strap 100, where "inside" means toward the user's body, and a convex curve 142 on the outside of the strap. Additionally, as discussed above, section 140 will generally be wider than sections 130 and 150, further helping to distribute the downward force. However, in some embodiments, section 140 will be the same or substantially the same width as sections 130 and 150. In some embodiments, section 140 may have a curved shape as illustrated. In some embodiments, section 140 may be more s-shaped, wherein a convex curve 143 follows concave curve 141, and concave curve 144 follows convex curve 142. This allows strap 100 to curve back toward a user's spine, helping to move the strap off the user's shoulder blade, further increasing the user's comfort. In some embodiments, section 140 may be substantially straight, but with a wider section as described above.

Figure 6:
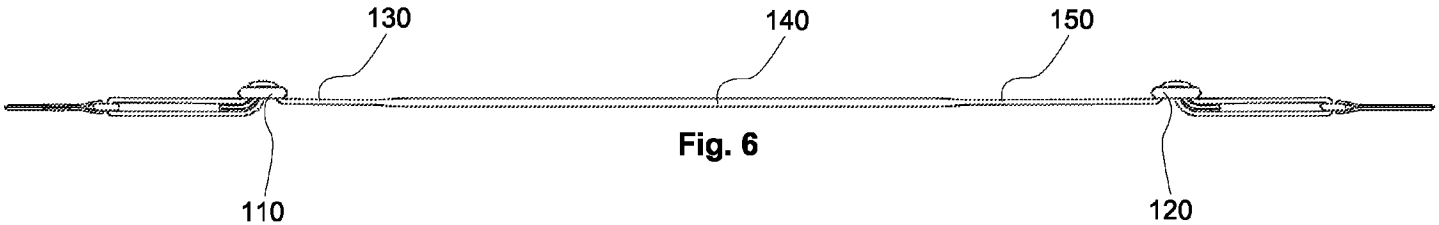
FIG. 6 is a side view thereof.
Figure 7:
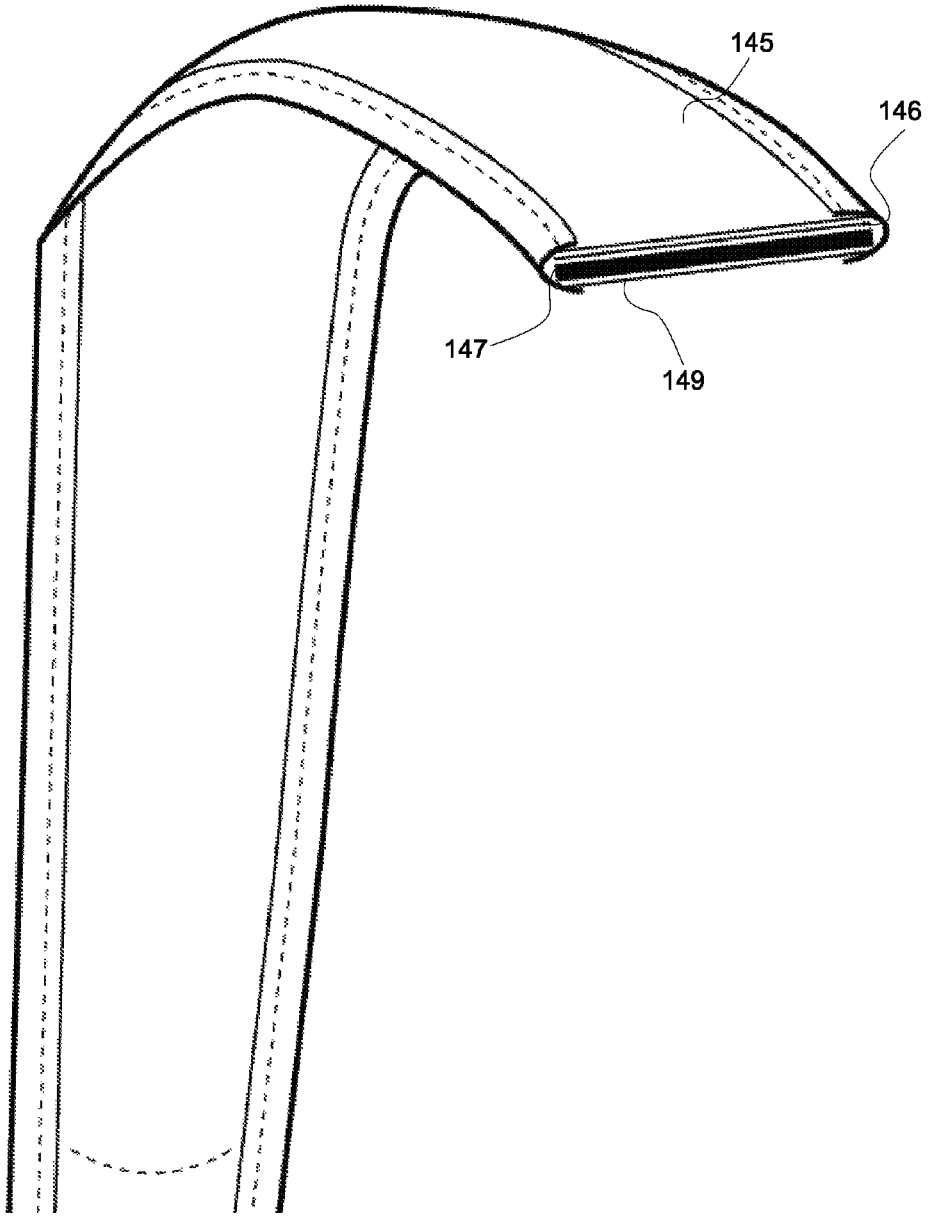
FIG. 7 is a cross-sectional view of a portion of one embodiment of the ergonomic instrument strap.
Figure 8:
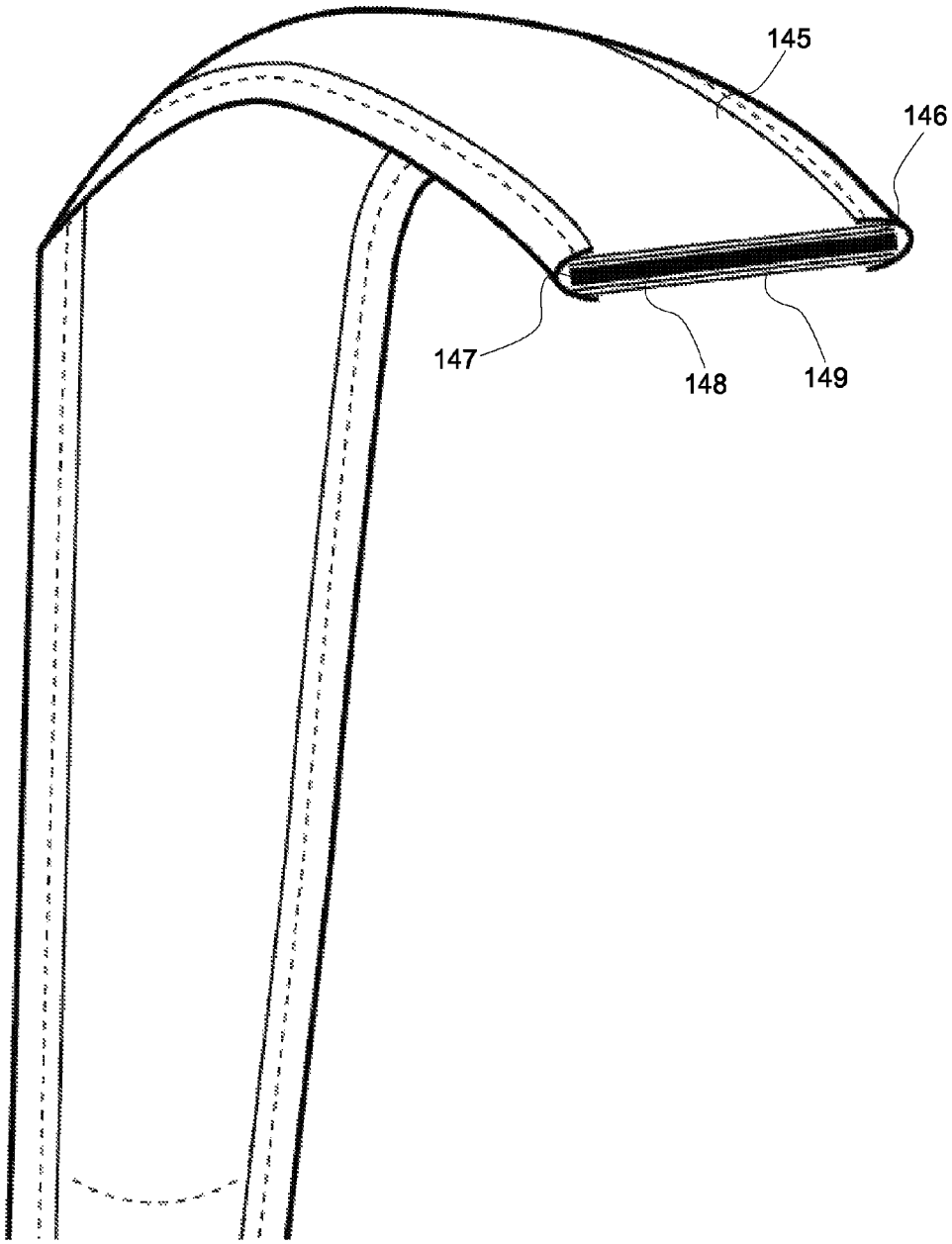
FIG. 8 is a cross-sectional view of a different embodiment of the ergonomic instrument strap

FIG. 6 is a side view of strap 100. In particular, FIG. 6 shows that sections 130 and 150 can, in some embodiments, be doubled up through length adjuster 110 and 120, respectively, to shorten the overall length of strap 100. Lengthening strap 100 simply requires pulling sections 130 and 150, or just one of the sections, back through the respective length adjuster. FIG. 6 also shows that, in some embodiments, section 140 may be thicker than sections 130 and 150. In other embodiments, section 140 may be the same or substantially the same thickness as sections 130 and 150. In a further embodiment, sections 130, 140, and 150 may be indistinguishable, such as when strap 100 is comprised of a single layer of flexible material. FIG. 7 goes into more detail on this feature, showing one embodiment of section 140 wherein the section is comprised of a top layer of fabric 145; a layer of interfacing, interlining, or other reinforcing material 146; a layer of padding 147, such as foam, batting, cotton stuffing, extra layers of cloth, etc.; and a bottom layer of fabric 149. This type of embodiment is preferred for a right or left specific strap 100. However, in some embodiments, strap 100 may be reversible, as shown in FIG. 8. In this exemplary embodiment, section 140 is comprised of a top layer of fabric 145; a top layer of interfacing, etc., 146; a layer of padding 147; a bottom layer of interfacing, etc., 148; and a bottom layer of fabric 149. When two layers of reinforcing material 146 and 148 are used, the type of reinforcing material may be the same or may be different, depending on the particular use or user preferences.

Figure 9:
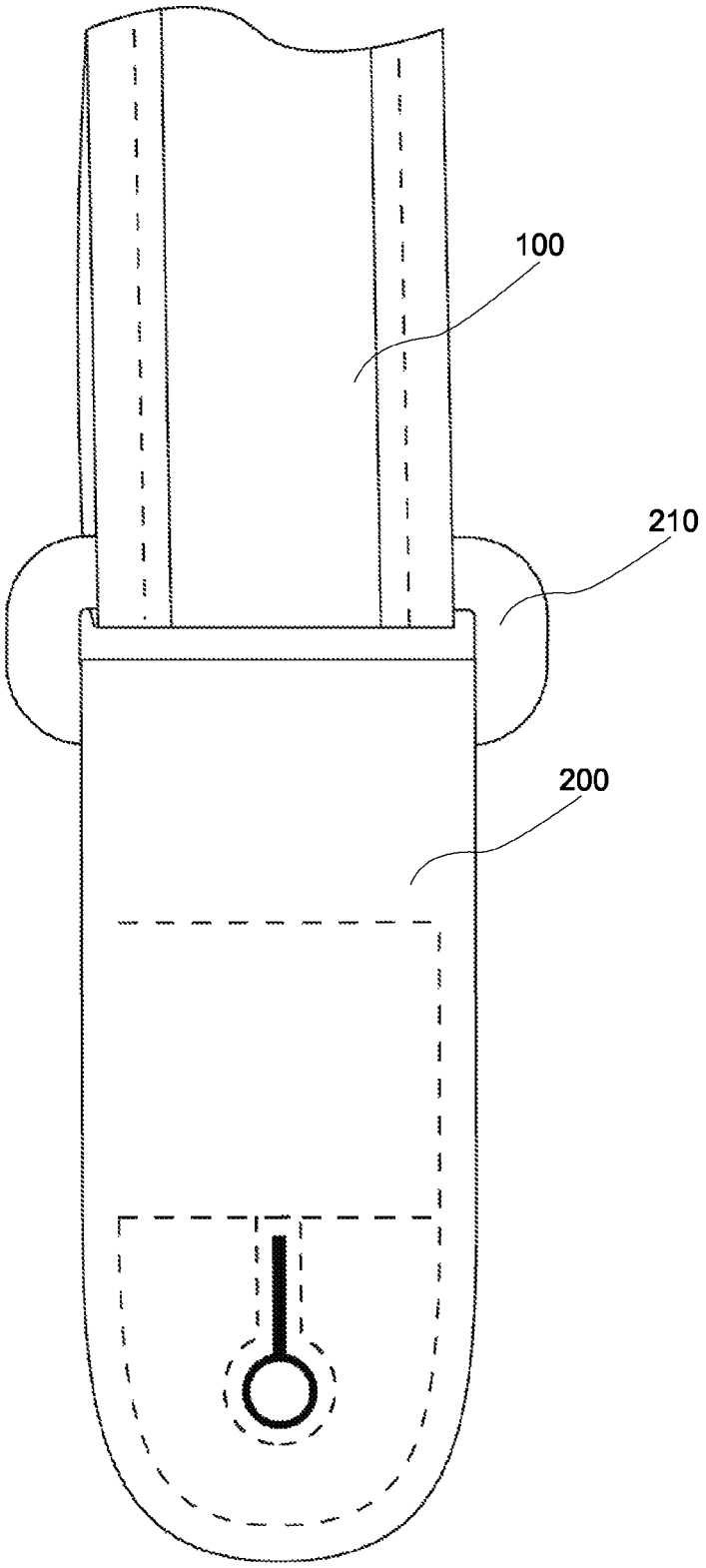
FIG. 9 is a close up view of one embodiment of the ergonomic instrument strap end piece.

FIG. 9 shows one embodiment of the ergonomic instrument strap in a close up view of end piece 200. Generally, end piece 200 will be coupled with at least one end of strap 100. However, end piece 200 may be manufactured separately, and, as such, may be useable with straight straps, c-shaped straps, and other instrument straps in general. In some embodiments, end piece 200 may be removable and replaceable from its joint with strap 100. In other embodiments, end piece 200 may be permanently joined with strap 100. In some embodiments, strap 100 may have an end piece 200 at only the neck end. In other embodiments, strap 100 may be coupled with an end piece 200 at only the body end. In a preferred embodiment, strap 100 may be coupled with an end piece 200 at both the neck end and the body end of the strap. In some embodiments, this coupling may be a seam. In other embodiments, the coupling may be buttons or rivets. In other embodiments, the coupling may be welding or gluing. In a preferred embodiment, strap 100 is coupled with end piece 200 through a single loop 210. Loop 210 may be any rigid material, such as plastic, wood, metal, metal plated plastic, etc. End piece 200 can be coupled with strap 100 in any manner in which two or more pieces of fabric are generally coupled.

End piece 200 can be any number of flexible or semi-flexible materials. In particular, the material will generally have a combination of flexibility, strength, and resistance to stretching. One primary goal of end piece 200 is to couple strap 100 with the plucked instrument to be played. A second primary goal of end piece 200 is to contain at least one extra pick to allow the user quick access to a replacement if a pick is lost. This is accomplished through the formation of a pocket, as illustrated in FIGS. 10 and 11, one of which may be able to store as many as six additional picks.

Figure 10:
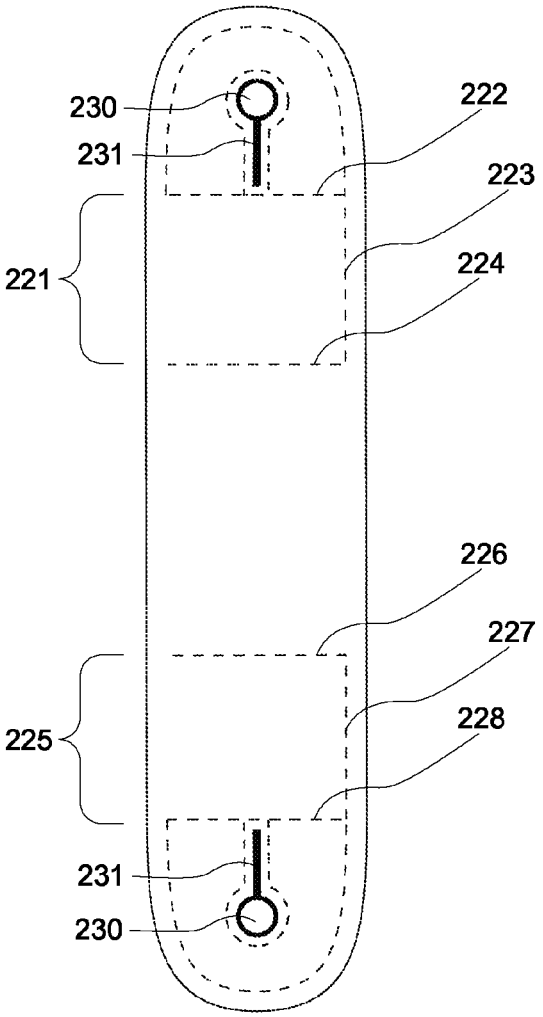
FIG. 10 is a view of one embodiment of the ergonomic instrument strap end piece.
Figure 11:
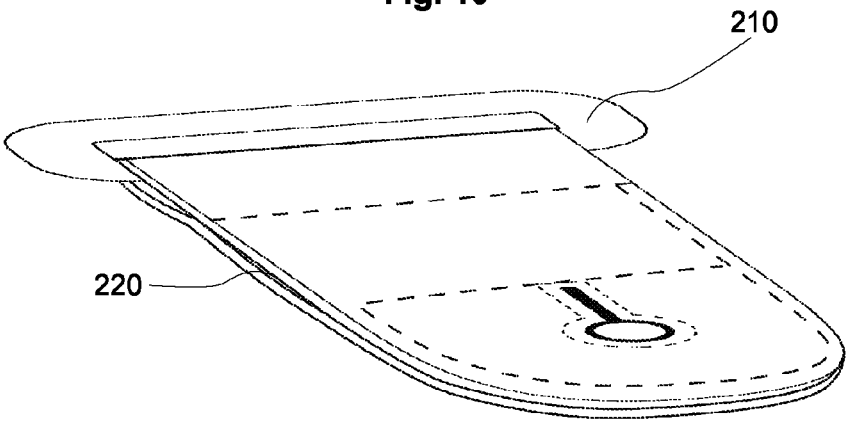
FIG. 11 is an isometric view of one embodiment of the ergonomic instrument strap end piece.

FIG. 10 shows an open view of one embodiment of end piece 200. This is the view if the end piece were to be laid out with stitch lines marked. At the top of FIG. 10, end piece 200 has a button hole 230 and a slit 231. This is how the strap 100 is coupled with a plucked instrument. For the purpose of this application, "button hole" is synonymous and interchangeable with "pin hole", as both are used interchangeably within the vernacular of the technology. Below button hole 230 is box 221, which is comprised of a top stitch line 222, an outside stitch line 223, and a bottom stitch line 224. At the bottom of FIG. 10, end piece 200 has the mirror image to button hole 230 and slit 231. Above that is box 225, comprised of top stitch line 226, outside stitch line 227, and bottom stitch line 228. Note that before end piece 200 is stitched closed, these lines may not actually be visible, and they are for illustration purposes only. FIG. 11 shows one exemplary embodiment of end piece 200 when it is stitched closed through a single loop 210. This shows that when box 221 is joined with box 225, it creates a pocket 220 in end piece 200, wherein the opening to the pocket is on the inside of strap 100.

In some embodiments, pocket 220 may be formed by other methods. For example, instead of folding two ends of one piece of fabric together and stitching a pocket, a pocket could be formed by stitching together two separate pieces of fabric; a portion of one piece of fabric could be stitched to a whole separate piece; multiple layers of fabric, meaning more than two, could be combined to form a pocket; a piece of stretchy material could be coupled with the flexible but stretch-resistant end piece to form a pocket, and so on. While a particular method of creating the pocket is disclosed herein as a preferred embodiment, it should be clear that any method of creating a pocket could be substituted without altering the function of the pocket.

Figure 16:
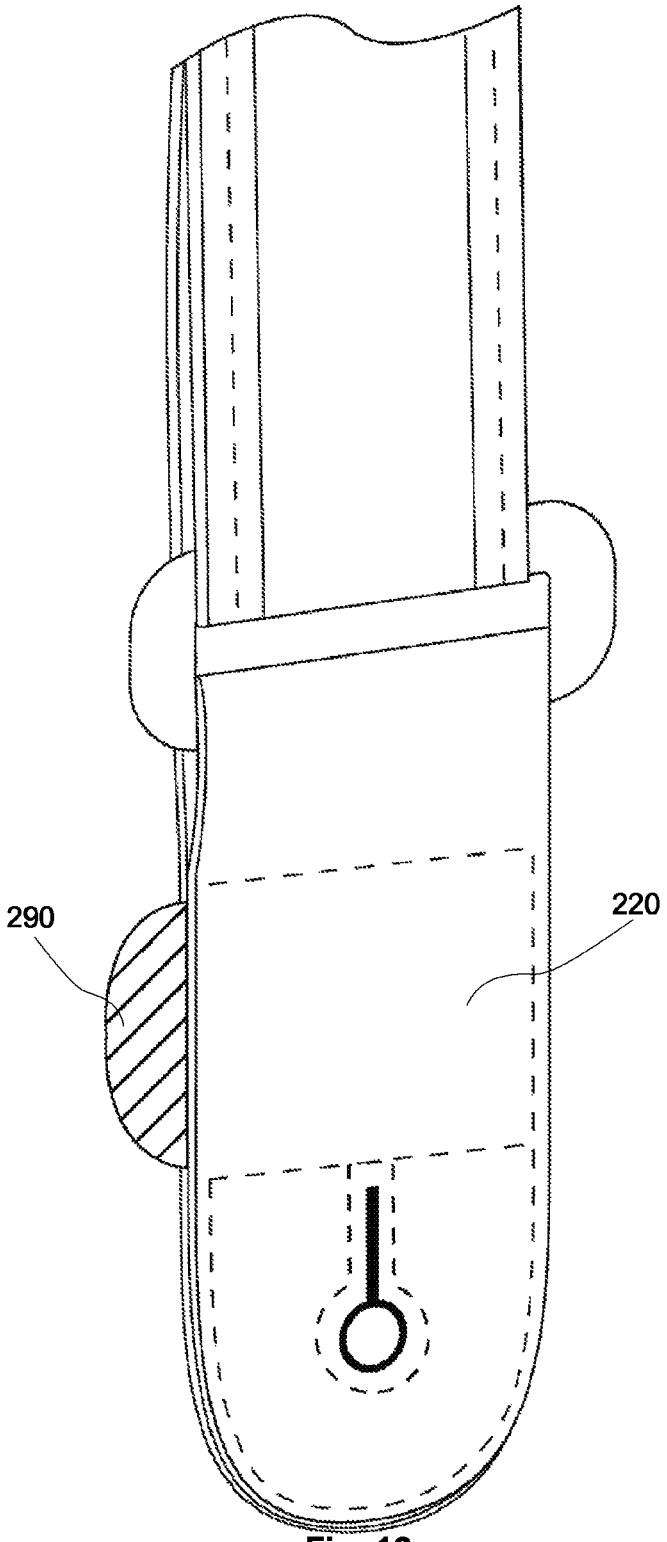
FIG. 16 is an isometric view of one embodiment of the ergonomic instrument strap end piece with a pick in place.

This is further illustrated in FIGS. 12 and 13, where a pocket is absent on FIG. 12, which is the outside of the strap, and visible in FIG. 13, the inside of the strap. FIG. 13 shows that when a pick 290 is inserted into pocket 220, it should fit snugly. This prevents the pick from falling out when the instrument is in use. Moreover, by having the pocket opening on the inside of the strap, rather than the top, the pick cannot fall deep into the pocket. This helps to keep the pick at a ready position so that a user does not have to dig or search for the pick that is expected to be in pocket 220. FIGS. 14 and 15 show that neck end piece 200 (FIG. 14) and body end piece 200 (FIG. 15) are mirror images of one another when stitched together. FIG. 16 is an isometric view of end piece 200 with pick 290 in pocket 220. This shows that pick 290 is presented to the user by virtue of the side opening on pocket 220, rather than having fallen into a pocket that opens at the top.

While "traditional" or "standard" picks are well known in shape and size, pocket 220 may be customizable for the size of the pick a user prefers. Commonly requested sizes may be 25 millimeters long by 23 millimeters wide, for picks known as "Jazz" style picks; 26 by 19 millimeters for "Teardrop" style picks; 29 by 25 millimeters for "traditional" style picks; and 31 by 32 millimeters for "Tri-Point" style picks. It should be noted that these measurements are exemplary only, and the pocket may be designed at a particular size to suit a user's preference. In some embodiments, pocket 220 may be slightly wider than a pick. In some embodiments, pocket 220 may be substantially the same width as a pick. In still other embodiments, pocket 220 may be slightly narrower than a pick. Similarly, in some embodiments, pocket 220 may be slightly deeper than a pick is long. In other embodiments, pocket 220 may be substantially the same depth as the length of a pick. In still other embodiments, pocket 220 may be slightly shallower than the length of a pick. In some embodiments, pocket 220 may be slightly thicker than the thickness of a pick. In other embodiments, pocket 220 may be substantially the same thickness as the thickness of a pick. In still other embodiments, pocket 220 may be slightly thinner than the thickness of a pick. The width, depth, and thickness of opening of pocket 220 may vary from end piece to end piece without impacting the function of the pocket.

Figure 17:
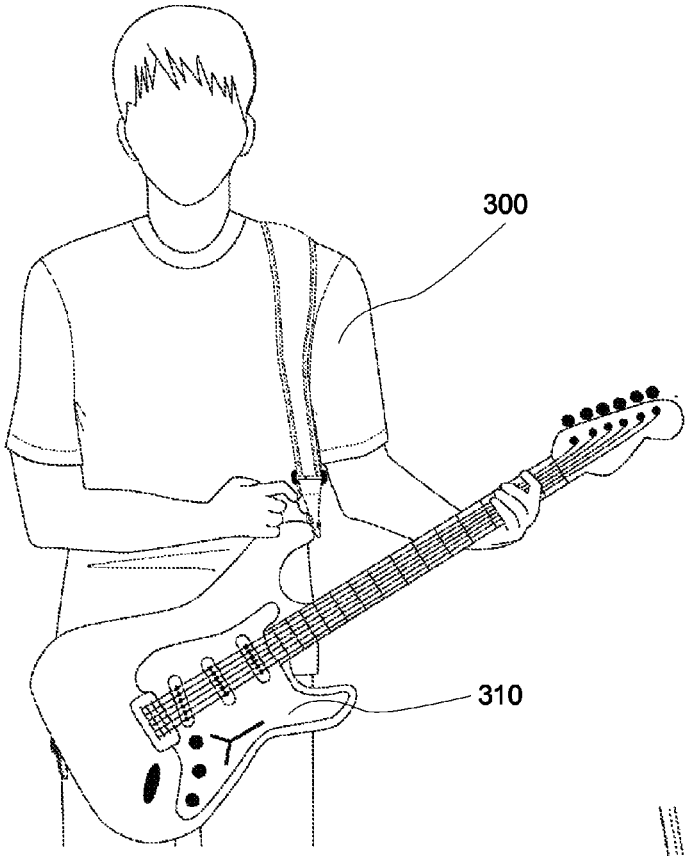
FIG. 17 is a front environmental view of one embodiment of the ergonomic instrument strap in use.
Figure 18:
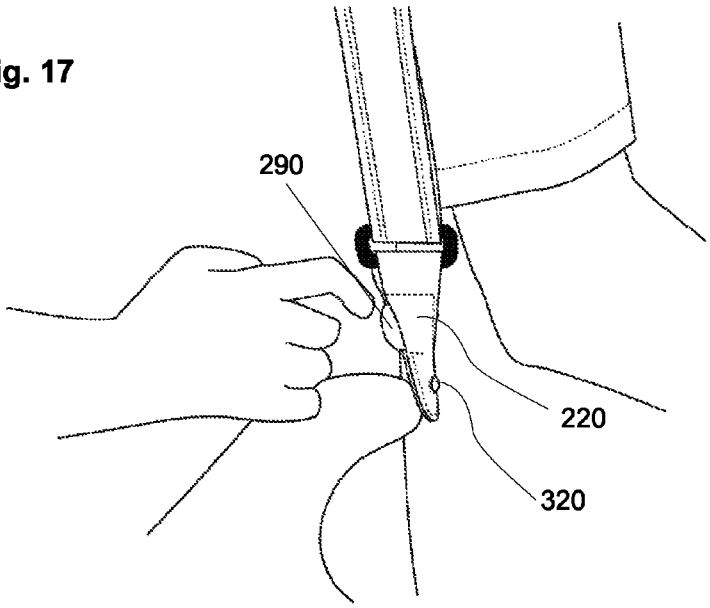
FIG. 18 is a detail view thereof.

FIG. 17 is an environmental front view of one embodiment of the ergonomic instrument strap in use. It shows the user 300 holding guitar 310 via strap 100. FIG. 18 is a detail view of the same, showing user 300 reaching for pick 290, which is contained in pocket 220. This figure illustrates the natural motion of drawing pick 290 from pocket 220, as opposed to, in non-limiting examples, finding one in a pants pocket or from someone else on stage. FIG. 18 also shows that neck pin 320 is disposed through button hole 230 on the neck end of strap 100.

Figure 19:
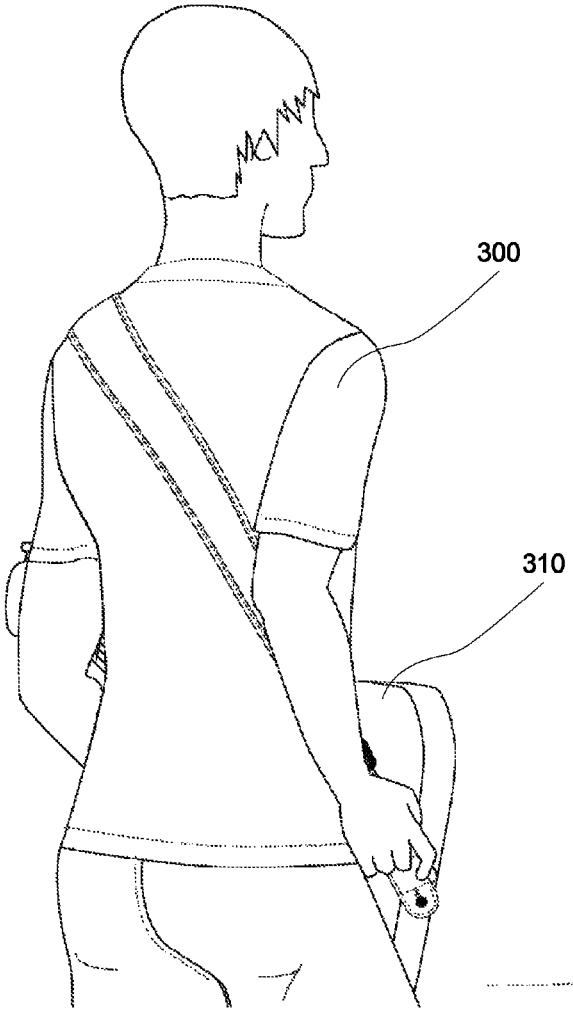
FIG. 19 is a rear environmental view of one embodiment of the ergonomic instrument strap in use.
Figure 20:
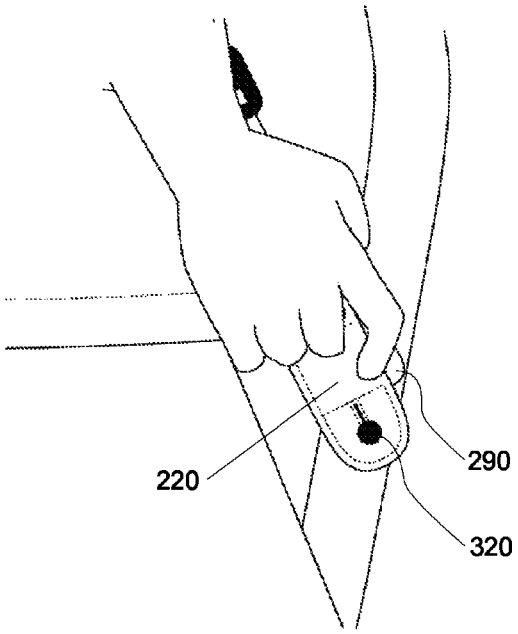
FIG. 20 is a detail view thereof.

FIG. 19 is an environmental back view of one embodiment of the ergonomic instrument strap in use. It shows the user 300 holding guitar 310 via strap 100. FIG. 20 is a detail view of the same, showing user 300 reaching for pick 290, which is contained in pocket 220. This figure illustrates the natural motion of drawing pick 290 from pocket 220, as opposed to finding one in a pants pocket or from someone else on stage. FIG. 19 also shows that body pin 320 is disposed through button hole 230 on the body end of strap 100. In some embodiments, strap 100 may include two end pieces. This allows a user to store two or more additional picks. Moreover, some users may prefer the motion of pulling a pick from the neck end piece 200, while others may prefer pulling a pick from the body end piece. In some embodiments, strap 100 may have only the neck or body end piece, depending on a user's preference. Either way, the motion of drawing a pick from pocket 220 is faster, smoother, and more ergonomic than any other means of recovering a pick.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. An instrument strap, comprising:

a length of flexible material having a neck end and a body end, the length of flexible material further comprising:

a narrow first portion beginning at the neck end;

a wide second portion beginning at the end of the first portion, wherein the wide second portion is comprised of at least one concave curve followed by at least one convex curve; and a narrow third portion beginning at the end of the second portion, wherein the wide second portion includes at least:

an upper layer of fabric;

at least one layer of padding material; and a lower layer of fabric.

2. The instrument strap of claim 1, further comprising:

at least a first end piece coupled with the length of flexible material at one of the neck end or the body end.

3. The instrument strap of claim 2, further comprising:

at least a second end piece coupled with the length of flexible material at one of the neck end or the body end.

4. The instrument strap of claim 1, wherein the wide second portion comprised of at least one concave curve followed by at least one convex curve is configured to move the strap away from a user's neck and off a user's shoulder blade.

5. The instrument strap of claim 1, wherein the wide second portion of the length of flexible material curves away from the user's body.

6. The instrument strap of claim 1, wherein the wide second portion of the length of flexible material first curves away from the user's body, then curves toward the user's body as the material progresses from neck end to body end.

7. The instrument strap of claim 1, wherein the end piece coupled with the length of flexible material further comprises:

a double layer of material stitched together to form a pocket.

8. The instrument strap of claim 7, wherein the pocket opens on a side of the end piece.

9. The instrument strap of claim 7, wherein the pocket opens on a side of the end piece facing the user's body.

10. The instrument strap of claim 1, further comprising:

at least one length adjuster.

11. The instrument strap of claim 9, wherein the at least one length adjuster is located near the neck end of the length of flexible material.

12. The instrument strap of claim 1, further comprising:

at least a first length adjuster and a second length adjuster.

13. The instrument strap of claim 11, wherein the first length adjuster is located near the neck end of the length of flexible material, and the second length adjuster is located near the body end of the length of flexible material.

14. The instrument strap of claim 1, wherein further comprising:

at least one layer of material disposed longitudinally along at least one edge of the strap.

15. The instrument strap of claim 7, wherein the pocket is configured to receive the wide end of a standard instrument pick.

16. An instrument strap, comprising:

a length of flexible material having a neck end and a body end, the length of flexible material further comprising:

a narrow first portion beginning at the neck end;

a wide second portion beginning at the end of the first portion, wherein the wide second portion is comprised of at least one concave curve followed by at least one convex curve; and a narrow third portion beginning at the end of the second portion, wherein the narrow first portion, the wide second portion, and the narrow third portion form a single unit, wherein the wide second portion further comprises:

at least one layer of padding material.

17. The instrument strap of claim 16, wherein the narrow first portion, the wide second portion, and the narrow third portion forming a single unit comprises:

an upper layer of fabric that extends from the neck end of the first portion to the body end of the second portion; and a lower layer of fabric that extends from the neck end of the first portion to the body end of the second portion, wherein the at least one layer of padding material of the wide second portion is disposed between the upper layer of fabric and the lower layer of fabric.

* * * * *